US009181723B2

(12) United States Patent
Schaefer

(10) Patent No.: US 9,181,723 B2
(45) Date of Patent: Nov. 10, 2015

(54) TENT FRAME COUPLER ASSEMBLY

(71) Applicant: Gary Schaefer, Belgrade, MT (US)

(72) Inventor: Gary Schaefer, Belgrade, MT (US)

( * ) Notice: Subject to any disclaimer, the term of this patent is extended or adjusted under 35 U.S.C. 154(b) by 0 days.

(21) Appl. No.: 13/999,505

(22) Filed: Mar. 5, 2014

(65) Prior Publication Data

US 2015/0252586 A1 Sep. 10, 2015

(51) Int. Cl.
*E04H 15/34* (2006.01)
*E04H 15/52* (2006.01)
*E04H 15/44* (2006.01)

(52) U.S. Cl.
CPC ..... *E04H 15/34* (2013.01); *E04H 15/44* (2013.01); *E04H 15/52* (2013.01)

(58) Field of Classification Search
USPC ..... 135/121, 122, 120.3, 157, 158, 160
See application file for complete search history.

(56) References Cited

U.S. PATENT DOCUMENTS

| | | | | | |
|---|---|---|---|---|---|
| 413,730 | A * | 10/1889 | Palmer | ..... | 135/160 |
| 1,204,329 | A * | 11/1916 | Wilkins | ..... | 135/160 |
| 1,846,011 | A * | 2/1932 | Adams | ..... | 135/158 |
| 2,788,011 | A * | 4/1957 | Turner | ..... | 135/160 |
| 3,424,178 | A * | 1/1969 | Yoshimi | ..... | 135/157 |
| 4,056,327 | A * | 11/1977 | Daus et al. | ..... | 403/172 |
| 4,084,598 | A * | 4/1978 | Rainwater | ..... | 135/121 |
| 4,683,901 | A * | 8/1987 | Mitchell | ..... | 135/97 |
| 4,882,884 | A * | 11/1989 | Browne | ..... | 52/82 |
| 5,167,246 | A * | 12/1992 | Mortenson | ..... | 135/153 |
| 5,584,311 | A * | 12/1996 | Schaefer | ..... | 135/128 |
| 5,661,942 | A * | 9/1997 | Palmer | ..... | 52/653.2 |
| 5,700,102 | A * | 12/1997 | Feleppa | ..... | 403/170 |
| 7,275,555 | B2 * | 10/2007 | Powell et al. | ..... | 135/122 |
| 7,296,584 | B2 * | 11/2007 | Goldwitz | ..... | 135/121 |
| 2008/0202574 | A1 * | 8/2008 | Milano et al. | ..... | 135/121 |

* cited by examiner

*Primary Examiner* — Noah Chandler Hawk
(74) *Attorney, Agent, or Firm* — D. L. Tschida

(57) ABSTRACT

A self-supporting tent support framework. The framework includes a number of support poles that interconnect at hinge, clevis/saddle and T/collar couplers to adjustably support the poles. The couplers retain the poles at user established angular orientations in multiple planes to support an overlying fabric cover. Each hinge coupler includes a pair of hinge pieces having a tubular sleeve body, an end collar that receives a transecting pivot pole and projecting wing arms overlap and fasten to support body mounted poles at an adjustable splay angle. Each clevis/saddle coupler includes a tubular sleeve body having depending parallel clevis arms that pivotally secure a pole to the clevis arms relative to a pole fitted to the sleeve body. Each T/collar coupler includes a tubular sleeve body and a pair of displaced, parallel coaxially projecting end collars having enclosed transverse coaxial through bores to adjustably support a T-aligned pole section.

7 Claims, 5 Drawing Sheets

TENT FRAME COUPLER ASSEMBLY

BACKGROUND OF THE INVENTION

The present invention relates to tent support framework systems and, in particular, to a multi-sectional tubular self-supporting framework assembly wherein a plurality of tubular pole pieces or sections are secured together with appropriate radially adjustable hinge couplers, in-line clevis/saddle couplers and "T or collar" couplers that longitudinally and transversely interconnect the tubular pole pieces to define a desired support framework.

With the increasing popularity of outdoor activities, a resurgence of interest has occurred in the camping industry. A variety of designs for stable, collapsible frame tents have evolved to meet this demand. Such tents are designed to meet the needs of a variety of users from backpackers, to weekend campers, who camp from their vehicle, to outfitted camps that are established in remote sites from horseback or four-wheeled vehicles.

Many tent support frames utilize a number of small diameter (i.e. less than ½ inch) poles constructed of fiberglass, aluminum or high strength materials. The poles frequently contain elastic shock cords and typically mount through fabric loops or to sleeves or clips secured to the tent fabric. With the assembly of the poles to define a framework, a fabric tent is draped over the frame and held taught with suitable fasteners. Some small tents provide self-contained support poles, which are permanently retained to the tent fabric.

Other or so-called "sheep herder or wall" tents have also shared in the resurgence of interest in camping. Historically, such tents were used by nomadic sheep herders, although wall tents are used to bivouac military and other personnel living and working from remote temporary sites. Tents offering comparable functionality are frequently used by recreating families and groups of hunters and fishermen for multi-day, base camps. The tents provide relatively large open floor living spaces that are heated with wood or gas stoves and contain various camp support furnishings in a weather protected setting. The fabric and other coverings for tents of this type however are relatively heavy and require a strong framework. Preferably the framework assembles with minimal effort and parts and provides multiple wind and snow stabilizing supports. Preferably too the support framework is modular and able to accommodate different arrangements of the support pieces.

Traditionally, the support framework for wall tents was mounted external to the fabric. More recently, internal frame support systems have been developed to more efficiently perform the same function with re-usable, lightweight tubular poles. These internal frame systems can also be used with one or more sections of tarpaulins to construct temporary weatherproof shelters such as for team sporting events or outdoor display/sale stalls for crafts, vegetables etc.

One such support system is described at U.S. Pat. No. 5,255,698. Rigid sleeve couplers are provided which retain pole sections that can be rotated in the sleeves. Although the '698 system adequately supports a tent and is susceptible to volume production with modular couplers, the couplers do not readily accommodate cabin style tents.

Another support system is disclosed at U.S. Pat. No. 5,069,238. This assembly provides hinged couplers which contain end support poles at a defined orientation to each other. Guy ropes, in turn, support the end frames and an overlying fabric cover. The couplers support the poles only in a single plane and are not able to contain longitudinal support poles, which are desired in a self-supporting framework.

Other couplers used in self-supporting frames are known which provide multiple sleeve segments that are welded at defined orientations to each other. A number of different types of couplers specific to each joint type are thus required to configure a desired framework. Correspondingly, it is necessary to stock a large variety of parts designed for each specific joint location, for example, inside/outside corners with defined angular orientations, straight couplers, T-couplers for horizontal ridge pole sections and associated vertical supports etc. Interconnecting pole pieces mount in the sleeves at specific structural locations and tarp(s) or a sewn contoured tent of a mating shape are fitted over the tubular frame skeleton.

To overcome the necessity of inventorying multiple parts and other logistics problems, a radially adjustable coupler was developed by applicant and is shown at U.S. Pat. No. 5,255,698. Such couplers are used in a variety of tent constructions including those shown in U.S. Pat. No. 6,273,114.

Couplers of the '698 type are used in frame systems constructed with several new coupler pieces of the present invention to facilitate construction of improved modular frameworks. The subject couplers were developed to provide flexibility and enhance the construction of wall-type tents and shelters.

The new improved couplers of the present invention were developed to enhance a user's options to tailor design a user's preferred tent support framework. The present invention provides for novel in-line clevis/saddle couplers that pivotally support pinned tubular pieces at any desired angular orientation between the ground or another coupler secured to an opposite end of the tubular section. Also disclosed is an "T or collar" coupler that can be used as an end fitting and that orthogonally pivots about a transecting interconnected pole piece. Hinged couplers providing adjustable and locked splay angles are also disclosed.

The improved couplers can be cast from aluminum, stainless steel or other suitable materials. The couplers are constructed to combine with interconnected tubular support pole pieces of 1 to 1½-inch diameter to form a strong, wind resistant support system for a canvas cover.

The present clevis/saddle, T/collar and hinge couplers are cast from appropriate metals and materials (e.g. aluminum, stainless steel etc.) to accommodate supported loads. The bores of the sleeves, collars and clevis saddles can be sized as desired to contain the coupled tubular pole pieces that radiate from the couplers. The poles can either be cut-to-length or can be mounted to telescope.

SUMMARY OF THE INVENTION

It is a primary object of the invention to provide a modularly configured tent support framework.

It is a further object of the invention to provide a framework including couplers capable of supporting a number of pole sections or pieces in multiple, interconnected planes.

It is a further object of the invention to provide a coupler accommodating a range of splay angles between interconnected poles, typically in truss-type gusset or cross bracing configurations.

It is a further object of the invention to provide a sleeve coupler adapted to coaxially receive one or more pole pieces inserted in a bore of a sleeve piece and pivotally support another pole piece from a depending clevis or saddle piece that transversely projects from the clevis/saddle of the sleeve piece.

It is a further object of the invention to provide a collared T-connection between transecting pole pieces wherein a 360° range of splay angles is possible between the sleeve coupled pole piece relative to a transecting interconnected pole piece coupled to a collar or eyelet end.

It is a further object of the invention to provide a T or collar coupler having a tubular sleeve body that receives a tubular pole piece and an eyelet or collar end having one or more circular appendages including a bore sized to mount over and pivot about a transecting pole piece.

It is a further object of the invention to provide a hinge coupler having multiple hinge arms that interconnect with each other at a hinge pole piece inserted through overlapped collar ends of the hinge coupler.

It is a further object of the invention to provide a hinge coupler having hinged sleeve pieces or sleeve bodies at one end that receive tubular splay pole pieces and bored eyelet or collar ends at an opposite end that receive a hinge pole piece and wherein arcuate wing arms extend from the sleeve bodies to overlap and fasten to each other and maintain a preferred splayed, angular orientation between the splay pole pieces that extend from the hinged sleeve pieces.

It is a further object of the invention to provide a hinge coupler having serrated, overlapping wing arms that contain overlapping slots or apertures that align and accept a support a fastener used to draw the arms together and secure the splayed pole pieces at a preferred angle.

The foregoing objects, advantages and distinctions of the invention are obtained in a modular tent support framework. The framework includes a number of tubular pole pieces that radiate from a number of in-line clevis/saddle couplers, collared T-couplers and/or radially adjustable hinge couplers. The system or collection of framework couplers assemble to form any desired support skeleton for an overlying fabric cover. The pole pieces can be cut to size or can telescope from each other. The pole pieces interconnect to selected couplers and are arrange able to provide vertical and longitudinal support for the fabric cover. Other selected couplers provide support bracing between adjacent pole pieces. The system of couplers is particularly adaptable to wall tents or other temporary outdoor shelters.

A sleeve body of the in-line clevis or saddle couplers couple to one or more coaxially aligned pole pieces and pivotally support another pole piece at an included depending clevis or saddle piece. A single or a pair of coaxially aligned pole pieces butted to each other mount in the sleeve body. Another pole piece is pivotally supported via a through mounted pivot fastener secured through the projecting clevis or saddle and projecting pole piece. The tubular sleeve body can be adapted to slide over one or more pole pieces. One or more set screw type fasteners can extend through the sleeve body to retain the coupled pole piece(s).

The clevis/saddle couplers particularly facilitate the construction of gussets or trusses to span corner connections or cross bracing between displaced pole pieces. Vertical support poles may also depend from the clevis or saddle piece when the clevis/saddle couplers are inserted into relatively long horizontal span (e.g. vertical ridge pole support). A variety other possible pole mountings are also possible.

The "T or collar" couplers provide a tubular sleeve portion and a double-eyelet or collar end piece. The collar or eyelet end piece allows a first pole piece to be mounted through a bore of the collar end. The collar coupler can rotate 360° about the first pole piece to any desired right angular orientation. A second pole piece mounts inside the tubular sleeve portion and extends at right angles to the transecting first pole piece. The collar couplers essentially provide a T-coupling and can be used as a ridge pole brace support or as a cross brace between horizontal tubular pole pieces or as a vertical ridge pole support that rests on the ground, among other uses.

The hinge couplers have interlocking hinged sleeve arms that couple together in the fashion of a hinge and collectively pivot orthogonally about a supported hinge pole piece (e.g. ridge pole section). The hinge pole piece mounts through aligned bores of collar ends of the hinge arms. Separate pole pieces coaxially extend from the bores of tubular sleeve pieces that extend from an opposite end of the arms at a suitable splay angle established upon fastening overlapping arcuate hinge, web or wing arms that project from the sleeve pieces with lynch pins or other suitable fasteners.

Each hinge, web or wing arm arcuately radiates from a sidewall of each sleeve piece and is aligned to overlap in parallel alignment to a mating hinge arm of the interconnected hinged sleeve arm. The overlapping arcuate wing arms include serrated interlocking surfaces. Upon inserting a pivot or hinge pole section through the bores of the overlapped closed eyelet-type end collars at each hinged sleeve arm and drawing and fastening the overlapping wing arms together with suitable fasteners, the splayed pole pieces extending from each sleeve piece provides a stable vertical support for the interconnected horizontal pole pieces (e.g. ridge pole).

With the aid of the several couplers a variety other tent framework pole mountings can be established as desired. Still other objects, advantages and distinctions of the invention are described at the following description with respect to the appended drawings. Various considered modifications and improvements are described as appropriate. The described couplers may be used alone or be combined in a variety of combinations to define any desired support framework. The description should therefore not be literally construed in limitation of the invention. Rather, the invention should be interpreted within the scope of the further appended claims.

DESCRIPTION OF THE PREFERRED EMBODIMENT

Figure 1:
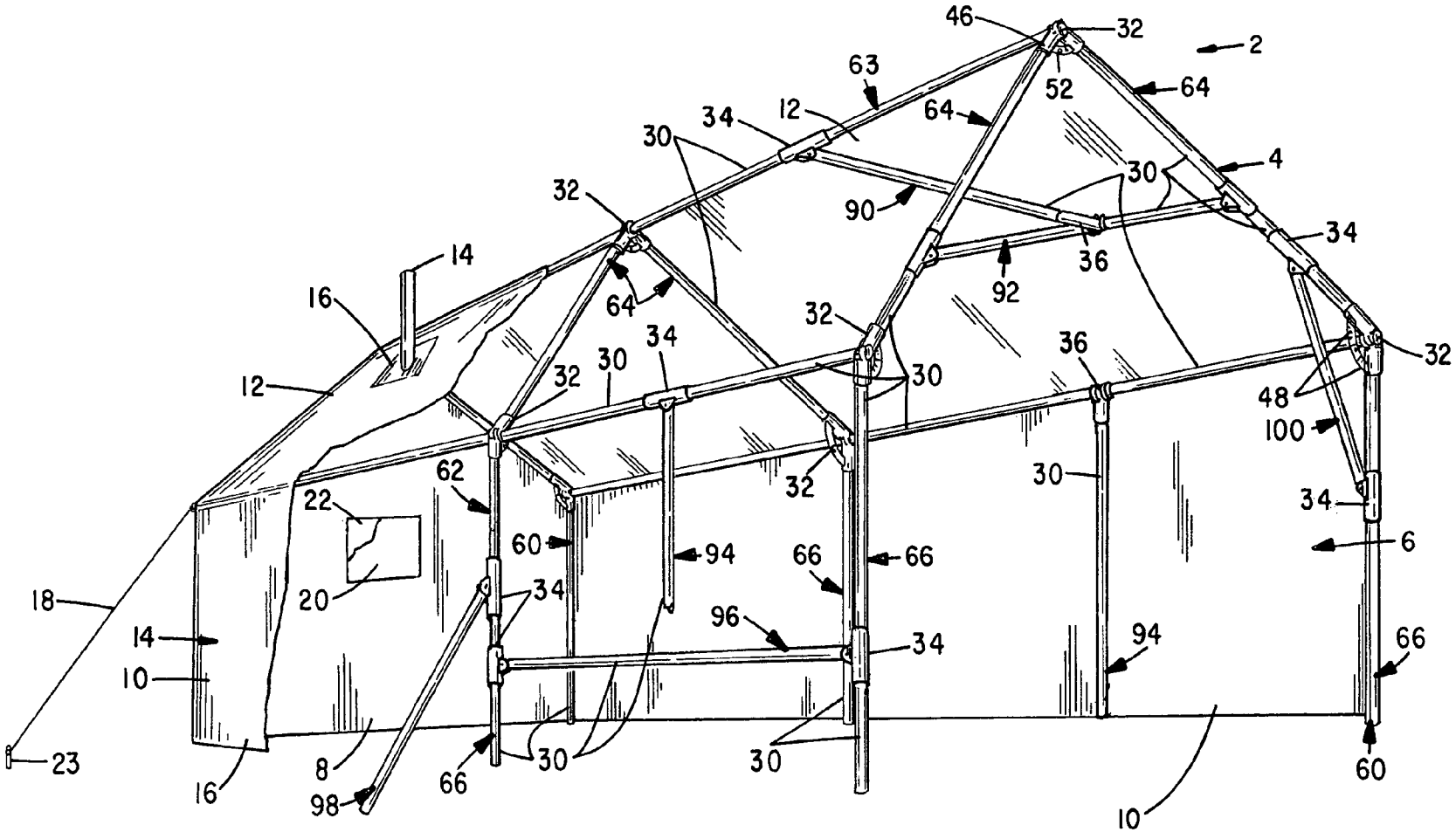
FIG. 1 is a perspective drawing shown in partial cutaway to a typical walled cabin-style tent and particularly to an included support framework having a number of novel in-line clevis/saddle couplers, T/collar couplers and hinge couplers arrayed in a variety of actual and possible orientations.

Referring to FIG. 1, a perspective drawing is shown to a typical self-supported wall tent 2. The tent 2 includes a support framework 4 that supports a fabric cover 6 sewn to provide a pair of end walls 8 (only one of which is shown), side walls 10, and splayed ceiling walls 12.

The cover 6 is constructed from a suitable grade of canvas or other waterproof material to resist wind, rain and snow. Depending upon the tent size, a number of fabric panels are sewn together to form the walls 8 and 10 and ceiling 12. A chimney 14 is mounted through a fireproof panel 16. Door access flaps with closure fasteners (not shown) are provided at one or both end walls 8 or can also be provided at the side walls 10. External tie down straps 18 are provided as required to stabilize the tent 2. Windows 20 and cover flaps 22 (shown in partial cutaway) may also be provided. Although one wall tent construction is shown, it is to be appreciated a variety of other shapes, sizes and arrangements of covers 6 can be fitted to a mating framework 4 erected to a complementary shape. The organization and features of each cover 6 can be varied to particular user needs.

The support framework 4 is correspondingly erected with a suitable number and types of interconnected pole sections and couplers. The framework 4 is particularly erected with a variety of coupler types discussed in detail below to define a desired arrangement of the pole sections adapted to the weight and wind loading of the tent 2.

The framework 4 is constructed of a number of tubular pole sections 30 that are fitted to a number of adjustable and/or pivoting support couplers. The framework particularly supports a number of adjustable hinge couplers 32, in-line clevis/saddle couplers 34 and T/collar couplers 36. Each of the couplers 32, 34 and 36 pivotally supports at least one associated pole section 30 as discussed below. The number and length of pole sections 30 required at the framework 4 depends upon the size of the tent 2, cover shape and the location of the couplers 32, 34 and 36 at the framework 4.

The couplers 32, 34 and 36 are constructed to support pole sections 30 of a nominal 1 to 2-inch diameter, although are adaptable with bushings or scaling to any diameter pipe, conduit etc. The pole pieces 30 are typically cut from tubular steel conduit but can be cut from aluminum, plastic or any other desired tubular stock. A variety of other solid and hollow pole stock materials of different cross sectional shapes may also be used to equal advantage to form the pole pieces 30.

Each hinge coupler 32 supports three pole sections 30 that extend in two orthogonal planes. Each hinge coupler 32 is constructed to provide a pair of interlocking hinge arms 40. The hinge arms 40 are interconnected with a pole piece 30 that is mounted through aligned bores 42 of interleaved circular eyelets or collars 44 that extend from an end of a tubular sleeve body 46. Arcuate hinge, webs or wing arms 48 project from the sidewalls of the sleeve bodies 46 and overlap along mating serrated surfaces 50. Fasteners 52 mounted through overlapped and aligned holes or slots in the wing arms 48 draw the serrated surfaces 50 together and lock the relative splay angle "A" between the sleeve bodies 46 and pole sections 30 that extend from the sleeve bodies 46.

Several hinge couplers 32 are used in the depicted framework 2 at end wall and center support assemblies 60 and 62. The couplers 32 are particularly mounted at the framework peak to a longitudinal ridge pole assembly 63 to support the coaxially arranged longitudinal pole sections 30. Rafter-type pole section sub-assemblies 64 project at a desired splay angle from the peak hinge couplers 32 and couple to vertical ground support pole sub-assemblies 66 that transition into ground contact. The spacing between the vertical assemblies 66 is determined from the adjusted splay angle A established at the peak hinge coupler 32 upon fastening the overlapped arcuate hinge arms 48 together with suitable bolt/nut or lynch pin fasteners 50.

The hinge arms 48 of each coupler 32 are constructed to interlock with one another upon aligning the collar bores 42 of the interleaved end collars 44 and mounting one or more pole sections 30 to the aligned bores 42. The bores 42 are sized to circumscribe the pole section 30 which acts as a pivot or hinge pin for the hinge coupler 32 and allows the hinge arms 46 to rotate relative to each other to define a desired splay angle "A". A single pole 30 may terminate at the interleaved bores 42, as in the case of an end wall assemblies 60 as shown at FIG. 1. Alternatively, when a coupler 32 is positioned along an intermediate section of a pole 30 as at the center support assembly 62, butted ends of mating pole sections 30 can be mounted in the aligned bores 42 of the conjoined collars 44.

The relative angular orientation of the pole sub-assemblies 64 and 66 is again maintained via the serrated interlocked surfaces 50. The hinge arms 48 of the presently preferred couplers 32 arcuately extend from the sleeve bodies 44 and overlap over a range of rotation on the order of 30° to 60° degrees. The hinge arms 48 can be secured to each other in a variety of fashions with a variety of fastener types 52. The hinge arms 48 presently include several apertures (e.g. holes, slots) that overlap at several defined splay angles "A". The fasteners 52 mount through the aligned apertures to fix the splay angle A.

Hinge arms 48 of differing shapes can be constructed that overlap over greater or lesser, defined ranges. Collectively, the splayed pole end wall and center support assemblies 60 and 62 and rafter and vertical support sub-assemblies 64 and 66 provide a stable vertical support at the ends and center of the interconnected horizontal ridge pole assembly 63 and included coaxially aligned pole sections 30. Each coupler 32 is thereby able to support multiple intersecting planar walls of the tent cover 6 in a variety of orientations and some of which are depicted in FIG. 1.

The hinge couplers 32, in-line clevis/saddle couplers 34 and T/collar couplers 36 are constructed of die cast metal such as aluminum or stainless steel. The hinge couplers 32, 34 and 36 can be formed from a variety of other materials, such as fiber impregnated plastic etc. provided the material is able to withstand the loading and environmental conditions.

The end collars 44 and/or sleeve bodies 46 can also include setscrew-type fasteners 52 to retain the collars 44 and sleeve bodies 46 to the interconnected pole pieces 30. Set screws, lynch pins or other fasteners 52 can be adapted to each hinge coupler 32 to achieve such ends. Preferably the fasteners 52 are located to prevent abrasive contact with the tent cover 6.

Figure 2:
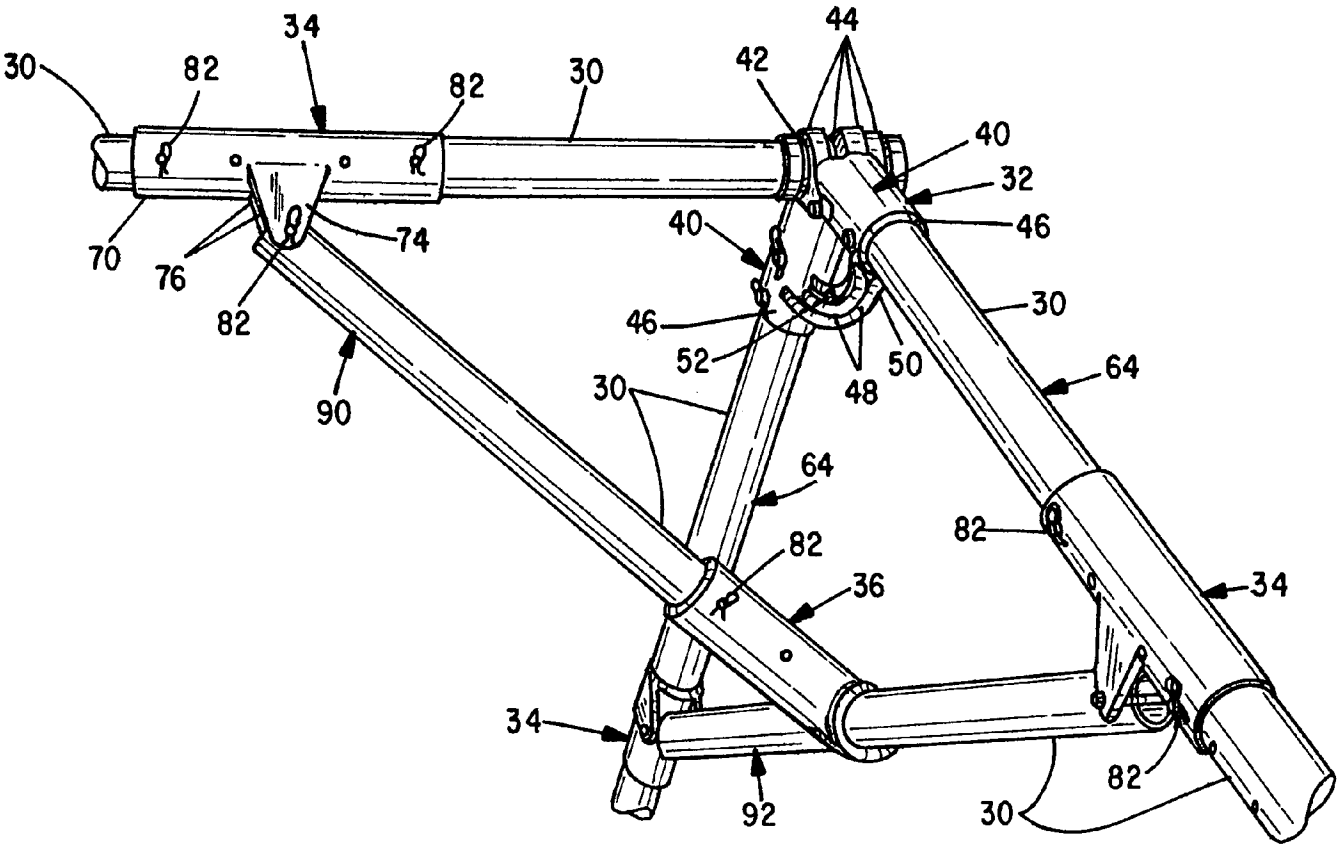
FIG. 2 is a perspective drawing showing several in-line clevis/saddle couplers, a T/collar couplers and a hinge coupler such as mounted at one end of the framework of FIG. 1.
Figure 3:
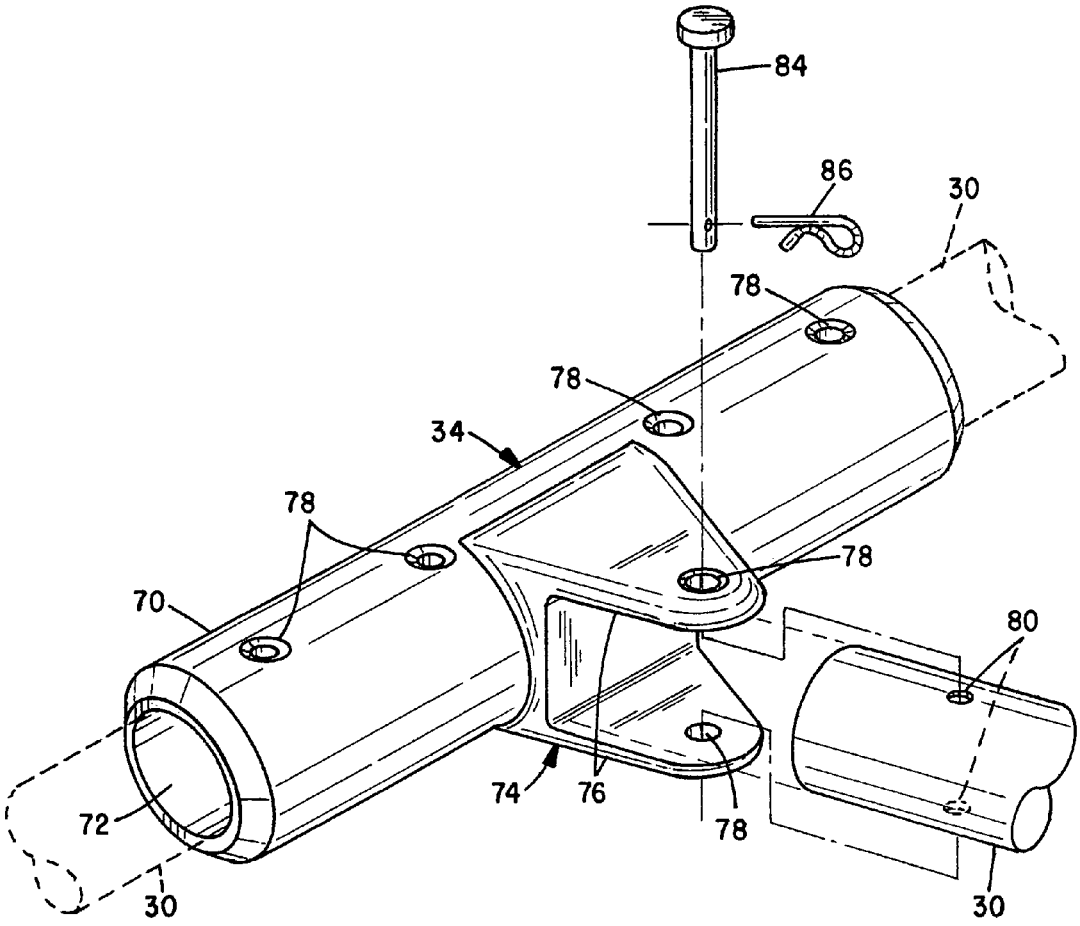
FIG. 3 is a perspective drawing showing an enlarged view of the in-line clevis/saddle coupler detached from typically associated pole pieces shown in dashed line.

FIGS. 2 and 3 depict detailed views to the in-line clevis/saddle coupler 34. The coupler 34 includes a tubular sleeve body 70 having a longitudinal bore 72. A clevis or saddle piece 74 having parallel flange arms or walls 76 projects from the sleeve body 70 and each arm includes an opposed aperture 78. The displaced walls 76 are separated sufficiently to receive the end of a pole section 30. Upon aligning the apertures 78 with apertures 80 at a pole section 30 and affixing a suitable pivot fastener 82 (e.g. lynch pin 84 and clip 86) through the aligned apertures 78 and 80, the attached pole piece 30 can pivot over a range of 180° from the clevis/saddle piece 74 relative to the sleeve body 70. Non-pivoting pole sections 30 are secured to the sleeve body 70 with other fasteners 82 aligned to apertures 78 formed through the side walls of the sleeve body 70

Advantageously, the in-line clevis/saddle couplers 34 are adapted to the framework 4 to facilitate a variety of support and bracing connections. As depicted in FIGS. 1 and 2 exemplary sub-assembly mountings of the clevis/saddle coupler are shown. FIG. 2 depicts three clevis/saddle couplers 34 that support a truss brace pole sub-assembly 90 and a cross brace pole sub-assembly 92.

FIG. 1 also depicts vertical brace support pole sub-assemblies 94, longitudinal brace pole sub-assemblies 96 and gusset brace pole sub-assemblies 98 and 100 that extend from the center framework assembly 62 and the end wall framework assembly 60. The vertical brace assembly 94 can extend to the ground or an adjoining cross brace or longitudinal brace sub-assembly 92 or 96 The longitudinal brace support pole sub-assemblies 96 stabilize the sidewalls in a similar fashion to the cross brace sub-assembly 92 and limit the bowing of the side walls 10 from heavy winds The truss, cross, vertical and gusset brace sub-assemblies 90, 92, 94, 98 and 100 stabilize the interconnected ridge pole assembly 63 and end wall assemblies 60. The depending pole sections 30 of the vertical and gusset support pole sub-assemblies 94 and 98 are set into the ground to provide additional support for the tie down straps 18. The gusset pole sub-assemblies 98 can be set at any desired angle relative to the side wall portions of the framework 4 of FIG. 1.

Figure 4:
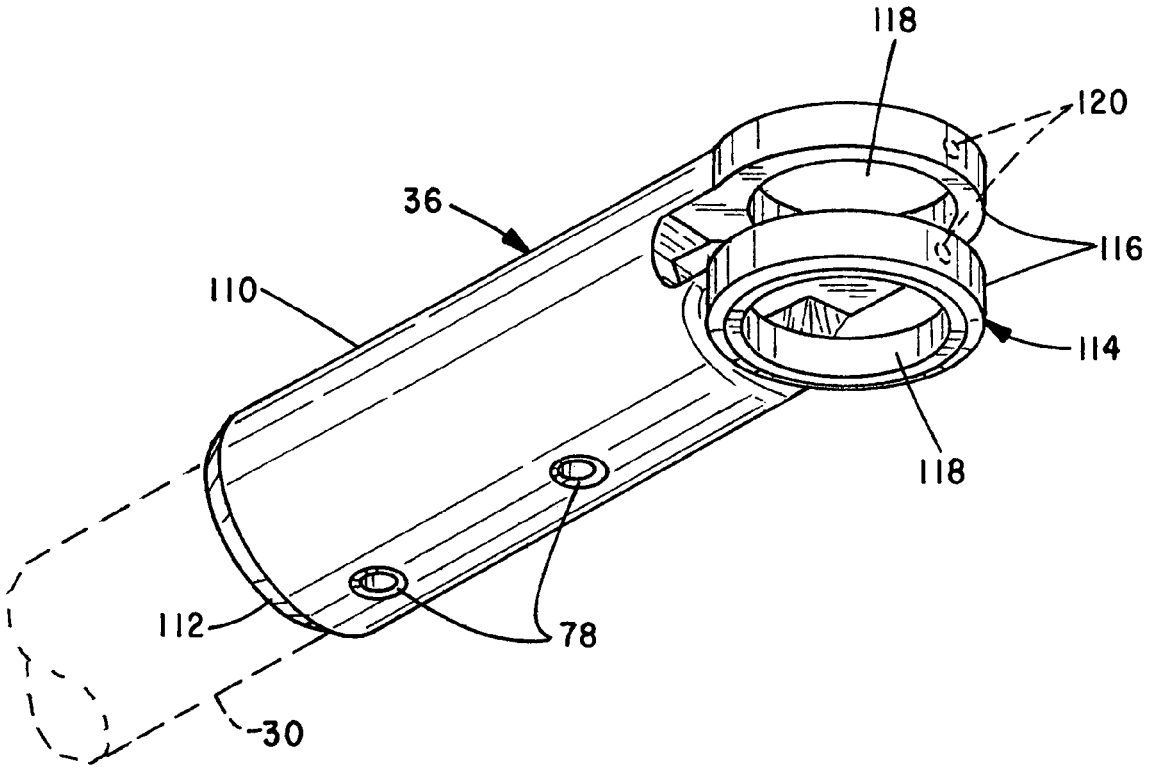
FIG. 4 is a perspective drawing showing an enlarged view of the T/collar coupler detached from typically associated pole pieces shown in dashed line.
Figure 5:
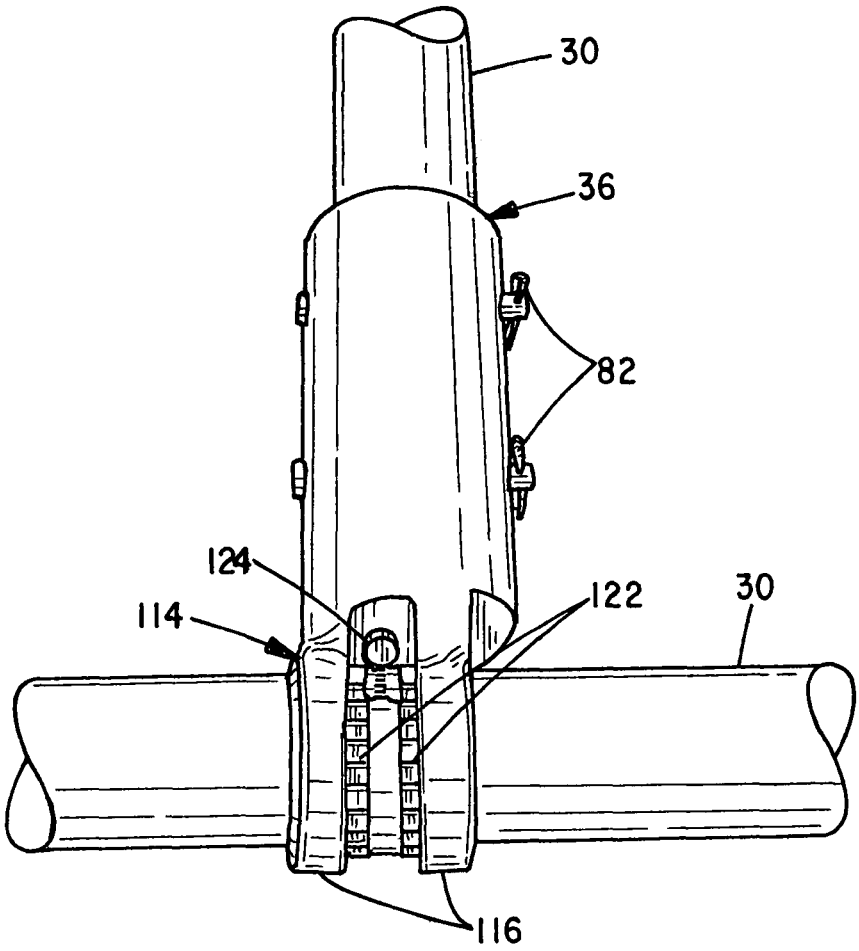
FIG. 5 is a perspective drawing showing an enlarged view of the T/collar coupler of FIG. 4 rotate to expose the relationship of the collar end piece to a transecting pole piece about which the coupler can be rotated over a range of 360°.

FIGS. 4 and 5 depict detailed views to the "T" or collar coupler 36. The T/collar coupler 36 includes a tubular sleeve body 110 having a longitudinal bore 112. An end collar 114 projects from the end of the sleeve body 110 and includes a pair of projecting collar arms 116 having opposed bores 118. The collar arms 116 are displaced sufficiently to spread support forces over a larger surface area of one or more interconnected pole sections 30.

The displacement of the collar arms 116 also permits two, butted pole sections 30 to mount within the end collar arms 116. Upon aligning and butting the pole sections 30 together in the end collar 114, set screws 120 (shown in dashed line) or other fasteners (e.g. hose clamp) can be tightened to secure the established relative orientation of the T/collar coupler 36 to the interconnected pole sections 30. Alternatively, the end collar 114 can be allowed to pivot about the orthogonally mounted pole section 30 mounted through the end collar 114. One or more tubular bushings 122 can be mounted between the collar arms 116 and pole section 30 to prevent abrasion and facilitate any desired pivot action. In lieu of set screws a clamping band fastener 124 can be mounted to the transecting pole section 30 between the collar arms 116 to prevent rotation of the T/collar coupler 36.

As noted at FIGS. 1 and 2, the T/collar couplers 36 are used in the truss brace sub-assembly 90 and vertical support sub-assembly 94 at the side wall 10. Depending upon any desired mounting and when a more rigid fastening is desired, the T/collar couplers 36 can be used instead of a clevis/saddle coupler 34. Lynch pin fasteners 82 mount through apertures 78 to secure the T/collar couplers 36 to a pole section 30 fitted to the bore 112.

While the invention has been described with respect to a presently preferred and considered alternative assemblies and sub-assemblies and considered improvements, modifications and/or alternatives thereto, still other assemblies and arrangements may be suggested to those skilled in the art. It is also to be appreciated that the features of the foregoing framework assemblies can be arranged in different combinations. The foregoing description should therefore be construed to include all those embodiments within the spirit and scope of the following claims.

What is claimed is:

1. A tent support framework assembly, comprising:

a) a plurality of poles;

b) a first coupler securing a plurality of said poles to one another, wherein said first coupler comprises first and second hollow tubular bodies, where each of said first and second bodies includes i) a longitudinal through bore defined by a circumferentially closed longitudinal wall and open at one end and a collar piece coaxially projecting from an end opposite said one end and having a bore defined through a circumferentially closed wall of said collar piece transverse to said longitudinal bore, and ii) a hinge arm arcuately projecting from an outer wall of each of the first and second bodies and having an aperture that projects transverse to the longitudinal bore, wherein first and second poles extend from the respective longitudinal bore of each of said first and second bodies, wherein the collar pieces of said first and second bodies are mounted to overlap each other at a third pole mounted through the aligned bores of said collar pieces, and wherein a fastener mounted through the hinge arm apertures secures said hinge arms together and fixes a splay angle between said first and second poles;

c) a second coupler securing a plurality of said poles to one another, wherein said second coupler comprises a hollow tubular body including a longitudinal through bore defined by a circumferentially closed longitudinal wall and open at opposite ends of the body, wherein first and second clevis arms project from the second coupler body and are spaced apart in opposed parallel relation to each other a distance sufficient to receive a pole therebetween and each includes an aperture, wherein a fourth pole extends from at least one end of the second coupler body, and wherein a fifth pole is secured to directly pivot about a pivot pin mounted through the fifth pole and the apertures of said first and second arms; and d) wherein said plurality of poles and first and second couplers are mounted to one another to project in multiple planes and form a self-supporting enclosed framework and to which framework a fabric tent cover is overlaid.

2. The tent support framework assembly as set forth in claim 1 including a third coupler securing a plurality of said poles to one another, wherein said third coupler comprises a tubular body having a longitudinal bore defined by a circumferentially closed longitudinal wall open at one end and a collar piece coaxially projecting from an end opposite said one end and having a bore defined through a circumferentially closed wall transverse to said longitudinal bore, wherein a sixth pole extends from the longitudinal bore of said body, and wherein a seventh pole transversely extends through the bore of said collar piece relative to said sixth pole.

3. The tent support framework assembly as set forth in claim 2 wherein the collar piece of said third coupler comprises first and second spaced apart cylindrical collars that coaxially extend parallel to each other from the third coupler body and have through bores coaxially and transversely aligned relative to the longitudinal body bore, and wherein the seventh pole mounts through the bores of said first and second collars.

4. The tent support framework assembly as set forth in claim 3 including means secured to the seventh pole extending through the first and second collars for preventing the rotation and lateral movement of the seventh pole relative to the third coupler body.

5. A tent support framework assembly, comprising:

a) a plurality of poles;

b) a first coupler comprising first and second hollow tubular bodies, where each of said first and second bodies includes i) a longitudinal through bore defined by a circumferentially closed longitudinal wall and open at one end and a collar piece coaxially projecting from an end opposite said one end and having a bore defined through a circumferentially closed wall transverse to said longitudinal bore, and ii) a hinge arm arcuately projecting from an outer wall of each of the first and second bodies and having an aperture that projects transverse to the longitudinal bore, wherein first and second poles extend from the respective longitudinal bores of said first and second bodies, wherein a third pole is mounted to extend through the bores of said collar pieces, and wherein a fastener mounted through the hinge arm apertures secures said hinge arms together and fixes a splay angle between said first and second poles;

c) a second coupler comprising a hollow tubular body including a longitudinal through bore having a circumferentially closed longitudinal wall and open opposite ends, wherein first and second clevis arms project from the second coupler body and are spaced apart in opposed parallel relation to each other a distance sufficient to receive a pole therebetween and each includes an aperture, wherein fourth and fifth poles extend from the ends of the ends of the second coupler body, and wherein a sixth pole is secured to directly pivot about a pivot pin mounted through the sixth pole and apertures of said first and second clevis arms;

d) a third coupler comprising a hollow tubular body having a longitudinal bore defined through a circumferentially closed longitudinal wall and a collar piece coaxially projecting from an opposite end and having a bore defined by a circumferentially closed wall extending transverse to said longitudinal bore, wherein a seventh pole extends from the longitudinal bore of the third coupler body and wherein an eighth pole transversely extends through the bore of said collar piece; and e) wherein said plurality of poles and first, second and third couplers are mounted to one another to project in multiple planes and form a self-supported enclosed framework and to which framework a fabric tent cover is secure.

6. A tent support framework assembly, comprising:

a) a plurality of poles;

b) a first coupler comprising a hollow tubular body having a longitudinal through bore defined by a circumferentially closed longitudinal wall open at one end and a collar piece coaxially projecting from an end opposite said one end and having a bore defined through a circumferentially closed wall transverse to said longitudinal bore, wherein a first pole extends from the longitudinal bore of said body, and wherein a second pole transversely extends through the bore of said collar piece relative to said first pole;

c) a second coupler comprising a hollow tubular body including a longitudinal through bore exposed at opposite ends of the body, wherein first and second clevis arms project from the second coupler body and are spaced apart in opposed parallel relation to each other a distance sufficient to receive a pole therebetween and each includes an aperture at a distal end, wherein third and fourth poles extend from the ends of the second coupler body, and wherein a fifth pole is secured to directly pivot about a pivot pin mounted through the fifth pole and the apertures of said first and second clevis arms; and d) a third coupler comprising first and second tubular bodies, where each of said first and second bodies includes i) a longitudinal bore exposed at one end and a collar piece projecting from an opposite end and having a bore defined through a circumferentially closed wall transverse to said longitudinal bore, and ii) a hinge arm arcuately projecting from a wall of each of said first and second bodies and having an aperture that projects transverse to the longitudinal bore, wherein sixth and seventh poles extend from the respective longitudinal bores of said first and second bodies, wherein the collar pieces of the first and second bodies are interleaved at an eighth pole mounted through the aligned bores of said collar pieces and the hinge arms overlap with the apertures aligned to support a fastener securing the hinge arms together and fixing a splay angle between said sixth and seventh poles; and e) wherein said plurality of poles project from said first, second and third couplers in multiple planes and form a self-supporting enclosed framework and to which framework a fabric tent cover is overlaid.

7. The tent support assembly as set forth in claim 6 wherein said hinge arms each include adjoining serrated surfaces that interlock with one another to maintain a determined splay angle.

* * * * *